US005608502A

United States Patent [19]

Yamashita et al.

[11] Patent Number: 5,608,502

[45] Date of Patent: Mar. 4, 1997

[54] METHOD FOR TREATING MAGNET ROLL BY BLASTING WITH NONMAGNETIC SPHERICAL PARTICLES

[75] Inventors: Keitaro Yamashita; Takeshi Satoh, both of Saitama, Japan

[73] Assignee: Hitachi Metals, Ltd., Tokyo, Japan

[21] Appl. No.: 508,338

[22] Filed: Jul. 27, 1995

Related U.S. Application Data

[63] Continuation of Ser. No. 77,089, Jun. 16, 1993, abandoned.

[30] Foreign Application Priority Data

Jun. 17, 1992 [JP] Japan ..... 4-157137

[51] Int. Cl.[6] ..... G03G 15/09

[52] U.S. Cl. ..... 399/276

[58] Field of Search ..... 355/251, 253; 118/657, 658

[56] References Cited

U.S. PATENT DOCUMENTS

| | | | |
|---|---|---|---|
| 4,554,234 | 11/1985 | Imai et al. | 118/658 X |
| 4,559,899 | 12/1985 | Kan et al. | 118/657 |
| 4,597,661 | 7/1986 | Yamashita | 118/658 X |
| 5,185,496 | 2/1993 | Nishimura et al. | 118/658 |
| 5,215,845 | 6/1993 | Yuso et al. | 355/251 X |
| 5,286,917 | 2/1994 | Unno et al. | 355/251 X |

FOREIGN PATENT DOCUMENTS

| | | | |
|---|---|---|---|
| 57-116372 | 7/1982 | Japan . | |
| 61-149973 | 7/1986 | Japan | 355/251[2] |
| 2-204764 | 8/1990 | Japan . | |
| 2-45189 | 10/1990 | Japan . | |

*Primary Examiner*—Fred L. Braun

*Attorney, Agent, or Firm*—Finnegan, Henderson, Farabow, Garrett & Dunner, L.L.P.

[57] ABSTRACT

A method for treating a magnet roll including the steps of providing a permanent magnet member having an outer circumferential surface and a plurality of axially extending magnetic poles formed in the outer circumferential surface, slidably surrounding the member with a non-magnetic metal sleeve of hollow cylindrical shape, the sleeve and the member being rotatable relative to each other, blasting a surface of the sleeve with spherical particles of a non-magnetic material having a density in a range of from 3 to 4 g/cm$^3$ and Mohs' hardness in a range of from 11 to 14 to produce a surface roughness ($R_z$) in a range of from 0.5 to 8 μm.

1 Claim, 1 Drawing Sheet

METHOD FOR TREATING MAGNET ROLL BY BLASTING WITH NONMAGNETIC SPHERICAL PARTICLES

This application is a continuation of application Ser. No. 08/077,089, filed Jun. 16, 1993, now abandoned.

BACKGROUND OF THE INVENTION

The present invention relates to a magnet roll used for carrying developer in electrophotography, electrostatic recording, and so on.

Most of magnet rolls used as developing rolls or cleaning rolls in conventional electrophotography or electrostatic recording have such a structure as shown in FIG. 1. In FIG. 1, reference numeral 1 represents a permanent magnet member. The permanent magnet member 1 is formed integrally into a columnar shape, for example, out of sintered powder of magnet material such as hard ferrite, or out of a mixture of ferromagnetic material and binder. A shaft 2 is coaxially fixed in the center of the permanent magnet member 1.

A plurality of axially extending magnetic poles (not-shown) are provided in the outer circumferential surface of the permanent magnet member 1. Next, flanges 3 and 4 are mounted on the shaft 2 at its opposite ends rotatably through bearings 5 and 5. A sleeve 6 formed into a hollow cylindrical shape is fixed to the flanges 3 and 4. The flanges 3 and 4 and the sleeve 6 are made of non-magnetic material such as an aluminum alloy, stainless steel, or the like. Reference numeral 7 represents a sealing member which is fixed between the flange 3 and the shaft 2. The permanent magnet member 1 is usually made to have a diameter in a range of from 15 to 60 mm and a length in a range of from 200 to 350 mm.

According to the above configuration, with the relative rotation between the permanent magnet member 1 and the sleeve 6 (for example, the permanent member 1 is fixed, and the flange 4 is rotated), magnetic developer is absorbed onto the outer circumferential surface of the sleeve 6 to thereby form a magnetic brush to make it possible to perform predetermined working of development, or the like.

In such a magnet roll, it has been known that it is effective to make the surface of the sleeve 6 rough in order to improve the performance of carrying magnetic developer from a developer tank to a development area. As a method of making the surface of the sleeve 6 so rough, there is, for example, a method of giving unshaped sand blasting to the surface of the sleeve 6, as disclosed in U.S. Pat. No. 4,597,661. According to this method, as its superior advantage, it is possible to stir developer by the roughened surface of the sleeve 6 to thereby maintain a proper charged condition, and also stabilize the layer thickness of the developer absorbed on the sleeve 6.

Further, in order to form a good condition of the surface of the sleeve 6 after the above-mentioned blasting, there have been proposed a method using shaped or spherical glass beads as blasting particles (for example, refer to Japanese Patent Unexamined Publication No. Sho-57-116372), a method using unshaped blasting particles together with shaped blasting particles (for example, refer to Japanese Patent Publication No. Hei-2-45189), a method using a mixture of spherical particles and unshaped particles (for example, refer to Japanese Patent Unexamined Publication No. Hei-2-204764), and so on.

Such various proposals have been created to improve the defects in the method using unshaped particles of $Al_2O_3$, $SiO_2$, or the like, in which not only the thickness of a developer layer absorbed and held on the toughened sleeve 6 becomes uneven, but the sleeve 6 is apt to be worn out because of the sharpened shapes of its roughened surface, so that the life of the sleeve 6 becomes short. However, the proposals have problems as follows.

First, in the proposal using glass beads (hereinafter referred to as "FGB"), blasting particles are so brittle as to be easily broken by an impact at the time of collision with the surface of the sleeve 6. Accordingly, there is a problem that the time to maintain predetermined particle size becomes so short that the lifetime is short. In this proposal, therefore, there is a disadvantage that it is necessary to often perform classification of used particles and supply of new particles.

In the proposal using steel balls or stainless steel beads, there is indeed an advantage that they are more durable than the above-mentioned FGB, so that the lifetime thereof is made long comparatively, but the density of material constituting them is so large that it is difficult to control the intensity of spray to the sleeve 6. In the proposal, accordingly, there is a problem that the blasting condition is narrow.

Moreover, in the proposal using steel balls, ferrite particles, or the like, as blasting particles, the balls or particles are constituted by magnetic material so that blasting particles are absorbed onto the surface of the sleeve 6 when blasting is performed in the state where the permanent magnet member 1 is incorporated in the sleeve 6 (usual manner). In this proposal, accordingly, there is a problem that the roughness formed in the surface of the sleeve 6 is apt to be uneven.

SUMMARY OF THE INVENTION

The present invention is intended to solve the foregoing problems in the conventional techniques, and it is an object thereof to provide a magnet roll having a sleeve having a uniformly roughened surface and superior in carrying property.

In order to attain the foregoing object, according to the present invention, in a magnet roll in which a permanent magnet member having a plurality of axially extending magnetic poles formed in its outer circumferential surface, and a sleeve of non-magnetic material formed into a hollow cylindrical shape are arranged to be rotatable relative to each other, the surface of the sleeve is made to have surface roughness ($R_z$) in a range of from 0.5 to 8 μm through blasting by using spherical particles of non-magnetic material having density in a range of from 3 to 4 g/cm$^3$ and Mohs' hardness in a range of from 11 to 14. "$R_z$" denotes average roughness of ten points (according to JIS B 0601).

As the spherical particles to be used according to the present invention, alumina, silicon carbide, boron carbide, and other high-hardness carbides, nitrides, and carbon-nitrides may be used. The spherical particles may be mixed with unshaped particles or non-spherical particles in blasting, or secondary blasting with the spherical particles may be performed after primary blasting with unshaped particles or non-spherical particles.

It is not preferable to make the surface roughness of the sleeve smaller than 0.5 μm, because not only the developer carrying property is lowered but the lifetime is shortened. If the surface roughness of the sleeve exceeds 8 μm, on the contrary, it is disadvantageous in that toner enters concave portions in the sleeve surface and is easily fused on the sleeve.

With the above-mentioned structure, it is possible to form an uniformly roughened surface in the surface of a sleeve, so that it is not only possible to improve the performance of carrying developer, but it is also possible to improve the durability of the roughened surface.

DETAILED DESCRIPTION OF THE INVENTION

Figure 1:
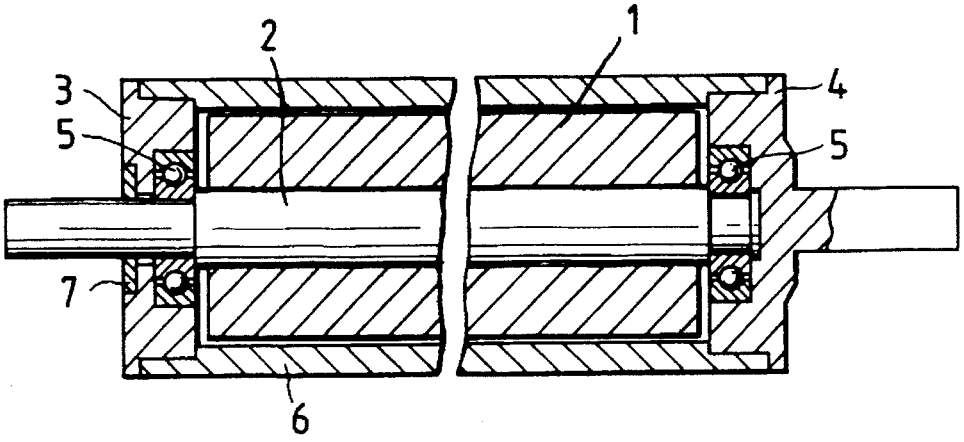
FIG. 1 is a partially omitted longitudinal sectional view illustrating an example of a magnet roll applied by the present invention.
Figure 2:
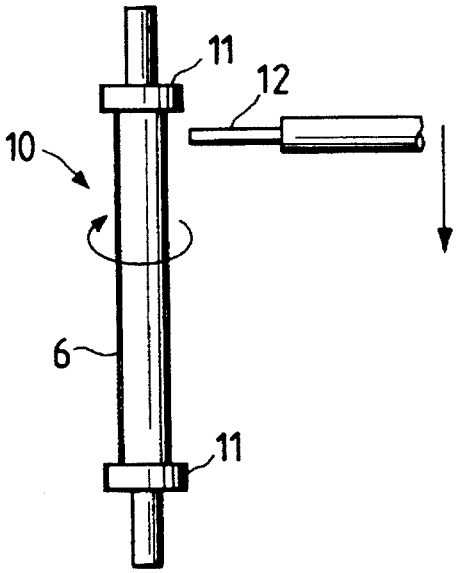
FIG. 2 is an explanatory diagram illustrating an example of a blasting equipment for a magnet roll according to an embodiment of the present invention.

FIG. 2 is an explanatory diagram illustrating an example of a blasting equipment for a magnet roll according to an embodiment of the present invention. In FIG. 2, reference numeral 10 represents a magnet roll having a configuration, for example, as shown in FIG. 1. Reference numeral 11 represents a masking member coaxially fixed to the end portion of a sleeve 6 and rotatably supported by a supporting member (not-shown) of the blasting equipment in order to prevent the members constituting the magnet roll 10, excepting the sleeve 6, from being roughened. Reference numeral 12 represents a nozzle provided with a predetermined interval to the sleeve 6 and formed to be able to project blasting particles together with compressed air, and to be able to move in the axial direction of the sleeve 6.

With the thus configured blasting equipment, the surface of the sleeve 6 of the magnet roll configured as shown in FIG. 1 was subjected to blasting. The permanent magnet member 1 in this case was symmetrically magnetized into eight poles, and the surface magnetic flux density of the sleeve 6 was made to be 750 G. Further, the sleeve 6 was made of SUS 304 and selected to be 18 mm in outer diameter. Next, the blasting conditions were such that the nozzle 12 in FIG. 2 was formed into 7 mm in its inner diameter, the distance between the nozzle 12 and the sleeve 6 was made to be 150 mm, the magnet roll 10 was rotated at 30 rpm, and the nozzle 12 was reciprocated at a rate of 1 reciprocation per second, and blasting was performed for 17 seconds. Then, spherical ALUNDUM particles (AX-50, equivalent to #300) and FGB as a comparative example were used as blasting particles, and compressed air was made to be 3.0 kg/cm$^2$ and 5.5 kg/cm$^2$ in each case.

Each of the magnet rolls subjected to blasting in the above-mentioned manner was built in a developing device, and continuous developing was performed at a rotation speed of 150 rpm of the sleeve 6. Used developer was a powder mixture of ferrite carrier (Cu—Zn group, average particle size 50 μm) and non magnetic toner (a volume average particle size 10 μm), and toner density was selected to be 3 weight %, and the height of the mountains of a magnetic blush was selected to be 0.5 mm.

Table 1 shows the result of the above-mentioned continuous development. The values in Table 1 are expressed by average values of 10 pieces. The carrying quantities were measured by extracting developer absorbed on the sleeve surface by using a bonding tape. In Table 1, the carrying quantities are expressed by relative values to the initial value of the example No. 1 which is regarded as 100.

TABLE 1

| | blasting conditions | | initial time | | after 25 h. | | comparison (×100%) | |
|---|---|---|---|---|---|---|---|---|
| No. | particle | air pressure (kg/cm$^2$) | surface roughness (R1) | carring quantity (W1) | surface roughness (R2) | carring quantity (W2) | $R_1 - R_2$ R1 | $\lvert W_1 - W_2 \rvert$ W1 |
| 1 | FGB | 3.0 | 2.51 | 100 | 1.88 | 110 | 25 | 10 |
| 2 | | 5.5 | 4.13 | 117 | 2.87 | 105 | 31 | 10 |
| 3 | alun- | 3.0 | 4.2 | 123 | 3.1 | 111 | 26 | 10 |
| 4 | dum | 5.5 | 6.1 | 124 | 4.2 | 109 | 31 | 12 |

As apparent from Table 1, it is understood that the surface roughness of a sleeve in No. 3 or 4 according to the present invention is more increased than that in No. 1 or 2 in convention, so that the developer carrying quantity is increased. Further, the surface roughness after continuous development, and the change of the developer carrying quantity are almost the same as those in the conventional case, so that satisfactory reliability can be recognized. It was confirmed that blasting particles in No. 3 and 4 according to the present invention are more difficult to be broken than conventional FGB in No. 1 and 2, that is, the quantity of minute powder produced is smaller, so that it is possible to reduce the consumption.

Figure 3A:
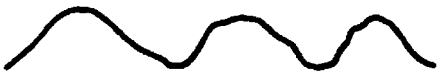
FIG. 3(a) PRIOR ART
FIGS. 3(*a*) and 3(*b*) are enlarged model diagrams illustrating surface states of sleeves; in which FIG. 3(*a*) shows the surface states in the conventional case and FIG. 3(*b*) shows the surface state in the embodiment of the present invention, respectively.
Figure 3B:
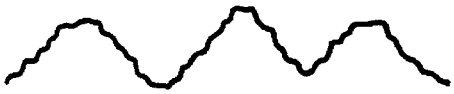

FIGS. 3(*a*) and 3(*b*) are enlarged model diagrams illustrating surface states of sleeves; FIG. 3(*a*) shows the conventional case, and FIG. 3(*b*) shows the embodiment of the present invention. In the conventional case of using conventional FGB, the surface is formed into a roughened surface which is comparatively smooth as shown in FIG. 3(*a*), while in the embodiment of the present invention shown in FIG. 3(*b*), the surface is formed into a roughened surface having minute roughness in addition to the conventional roughness. This was also confirmed by observing the respective surfaces of both the cases by using a microscope. It is inferred that by such a difference in the sleeve surface, the developer carrying performance and the durability of the roughened surface are improved, as described above.

According to the present invention having such a configuration and operation as mentioned above, it is possible to form an uniformly roughened surface in the surface of a sleeve so that there is an effect that the developer carrying performance and the durability of the roughened surface can be improved.

What is claimed is:

1. A method for treating a magnet roll comprising the steps of:

providing a permanent magnet member having an outer circumferential surface and a plurality of axially extending magnetic poles formed in the outer circumferential surface;

slidably surrounding said member with a stainless steel sleeve of hollow cylindrical shape, said sleeve and said member being rotatable relative to each other; and blasting a surface of said sleeve with spherical particles of ALUNDUM having a density in a range of from 3 to 4 $g/cm^3$ and Mohs' hardness in a range of from 11 to 14 to produce a surface roughness ($R_z$) in a range of from 0.5 to 8 μm.

* * * * *